US006693262B2

(12) United States Patent
Gerola et al.

(10) Patent No.: US 6,693,262 B2
(45) Date of Patent: Feb. 17, 2004

(54) COOKING HOB WITH DISCRETE DISTRIBUTED HEATING ELEMENTS

(75) Inventors: Davide Gerola, Varese (IT); Cristiano Pastore, Borgomanero (IT)

(73) Assignee: Whirlpool Corporation, Benton Harbor, MI (US)

( * ) Notice: Subject to any disclaimer, the term of this patent is extended or adjusted under 35 U.S.C. 154(b) by 105 days.

(21) Appl. No.: 09/981,035

(22) Filed: Oct. 17, 2001

(65) Prior Publication Data

US 2003/0071031 A1 Apr. 17, 2003

(51) Int. Cl.[7] ..... H05B 3/68
(52) U.S. Cl. ..... 219/462.1; 219/518
(58) Field of Search ..... 219/445.1, 446.1, 219/447.1, 448.11, 448.12, 460.1, 461.1, 462.1, 518

(56) References Cited

U.S. PATENT DOCUMENTS 4,316,080 A * 2/1982 Wroblewski ..... 219/505
4,551,600 A * 11/1985 Miyagawa et al. ..... 219/623
5,097,113 A * 3/1992 Aoyama ..... 219/445.1
5,149,944 A * 9/1992 Shimomura ..... 219/445.1
5,243,171 A * 9/1993 Wood et al. ..... 219/386
5,658,478 A * 8/1997 Roeschel et al. ..... 219/502

FOREIGN PATENT DOCUMENTS

DE 40 07 680 * 1/1991
WO 97/18298 * 5/1997

* cited by examiner

*Primary Examiner*—Sang Y. Paik
(74) *Attorney, Agent, or Firm*—Thomas J. Roth; Robert O. Rice; John F. Colligan

(57) ABSTRACT

A cooking hob comprising a glass ceramic plate and an underlying plurality of electrical heating elements disposed in matrix configuration and controlled by static switches in order to be able to use at will any region of said hob for heating the contents of one or more cooking utensils, in which a diode is present in series with each electrical heating element.

16 Claims, 6 Drawing Sheets

SEQUENZA ACCENSIONI

COOKING HOB WITH DISCRETE DISTRIBUTED HEATING ELEMENTS

BACKGROUND OF THE INVENTION

1. Field of the Invention

The present invention relates to a cooking hob comprising a plurality of electrically powered heating elements (for example resistors or halogen lamps) distributed below a heat-resistant surface (for example of glass ceramic) on which a utensil is placed for the heat treatment (for example, cooking, heating or thawing) of a food contained therein, the heating elements being disposed in matrix arrangement, in accordance with the introduction to the accompanying claim 1.

2. Description of the Related Art

High versatility cooking hobs are known on which the user can locate several cooking utensils, even of different contour, in any desired regions and activate only those heating elements present in each of said regions; each corresponds at least approximately to the contour of the utensil itself.

In the known art, represented for example by DE 4007600 and WO 97/19298, the heating elements are disposed in a matrix configuration.

The first of the two said prior patents comprises a series of cooking regions and sensors which, associated with these regions, activate those covered by the cooking utensil. The purpose of this known solution is to avoid the use of switches or other user-operated control means. In the second previous patent the heating elements are also disposed in matrix formation and are each associated with thermal load monitoring means, which cut off the power if the load is absent. The matrix arrangement of the heating elements provided therein has however the drawback of not enabling "zero" level (open circuit) to be obtained for other heating elements not required by the cooking utensil.

SUMMARY OF THE INVENTION

The objects of the present invention are to provide a cooking hob comprising a plurality of matrix-arranged electrical heating elements which not only provides versatility but also offers the necessary protection from overtemperature and achieves power cut-off to those heating elements not required by the cooking utensil or utensils.

These and further objects which will be more apparent from the ensuing detailed description are attained by a cooking hob in accordance with the teachings of the accompanying claims.

BRIEF DESCRIPTION OF THE DRAWINGS

The invention will be better understood from the detailed description of some preferred embodiments thereof given hereinafter by way of non-limiting example and illustrated in the accompanying drawings, in which.

FIGS. from 9A to 9M show in the first case the position of two cooking utensils on a cooking hob represented schematically as a chess board with the heating elements situated at the squares, whereas the other figures of the group show a possible sequence of activation of the heating elements required by two cooking utensils; the active heating squares of which are identified by shading; that shown in this group of figures represents a comparison solution.

Figure 11:
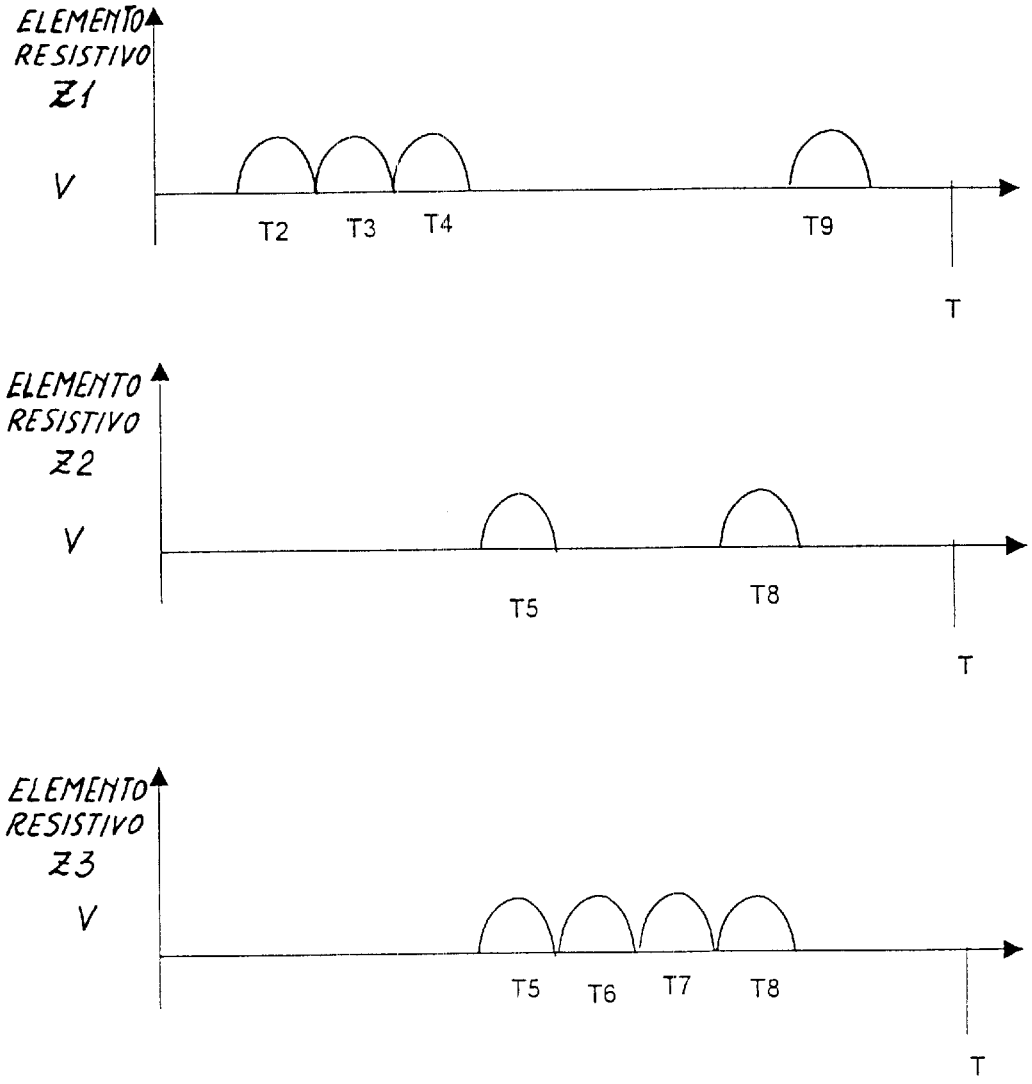

FIGS. from 10A to 10M represent an analogous solution incorporating the teachings of the invention; and FIG. 11 shows the powering of three specific resistance elements against time in relation to the preceding figures.

DESCRIPTION OF THE PREFERRED EMBODIMENT

In the figures the reference numeral 1 indicates overall a cooking hob comprising a conventional glass ceramic plate 2 on which cooking utensils of any form, indicated by 3 and 4, are rested in any regions of the plate 2. Below the plate 2 there are provided a plurality of identical heating elements 5*a, b, c* etc., for example resistors disposed spirally to cover overall the maximum useful area of the plate 2. Conceptually, the heating element can be considered a "thermal cell", each cell being controllable substantially independent of the others or also in combination with other specific cells concerned, where these lie below one and the same cooking utensil; groups of cells can also be independently controlled where each group is dedicated to a different specific cooking utensil on the basis of its contour.

The heating elements 5 are supported by an underplate 6 of electrically and thermally insulating material, bounded by a thermally insulating surrounding side wall 6A which together with the underplate 6 and plate 2 defines a compartment for containing the plurality of heating elements.

Figure 1:
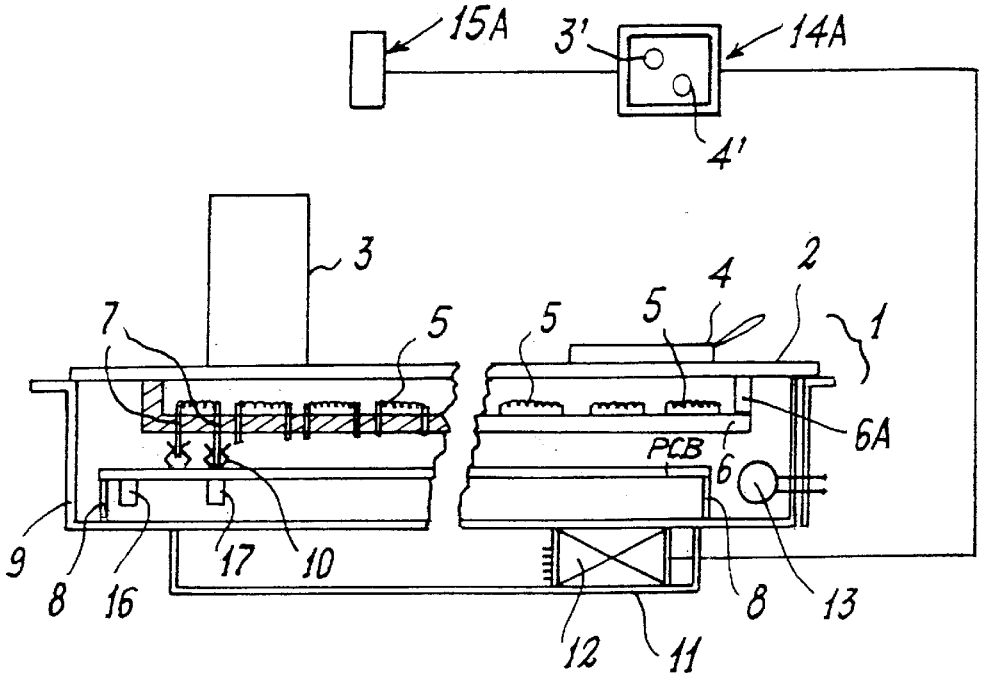
FIG. 1 is a vertical section through a first embodiment of the cooking hob of the invention associated with a means or device for selecting the cooking positions and powers.
Figure 2:
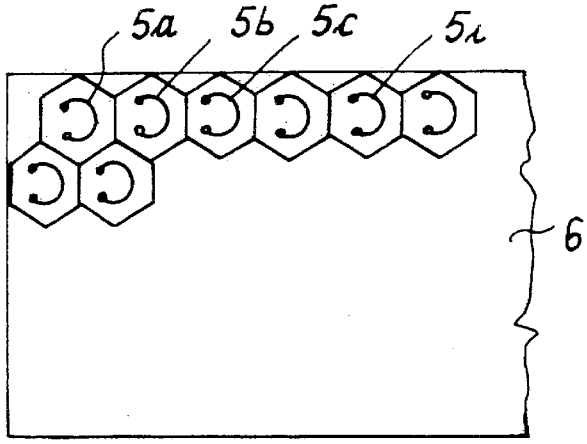
FIG. 2 is a schematic view of the heating element arrangement on the cooking hob.
Figure 3:
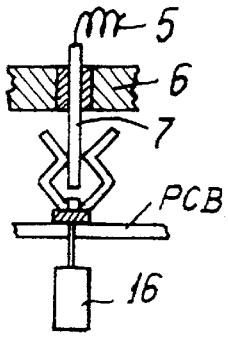
FIG. 3 is a schematic vertical section showing a method of connecting one end of an electrical heating element (in this example a resistor) to the power circuit.
Figure 4:
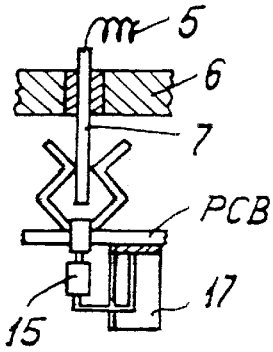
FIG. 4 is a schematic view similar to FIG. 3 showing a method of connecting the other end of the resistor to a diode.

The ends of the heating elements 5 are connected in this example to conductive pins 7 which pass through and project from the underplate 6. The pins 7 (see FIGS. 3 and 4 in particular) are intended to be engaged by conductive spring clips 10 rigid with printed circuit boards PCB supported via conventional columns 8 by a tray for example of sheet metal 9 forming part of the structure of the cooking hob 1. As will be clarified hereinafter, in addition to the clamps these printed circuit boards comprise conductive tracks, static switches 16, 17 (for example triacs, mosfets, SCRs) and diodes. The underlying compartment 11 holds the electronic control circuit 12 for the static switches and possibly the static switches themselves. The tray 9 can contain a tangential fan 13 for cooling the static switches and diodes, and the underlying compartment can contain a bridge rectifier with non-filtered output (indicated by 14 in FIG. 5) if the heating elements are to be powered from a half-wave supply of equal polarity. The fan can also be located at another "cold" point and the cooling air be fed through a conduit.

The electronic control circuit 12 is connected to a touch screen 14A connected to a small CCD video camera 15A framing the cooking hob. The cooking hob appears on the screen 14A together with the cooking utensils positioned thereon, for example the two indicated by 3 and 4, the reproductions of which on the screen are identified by 3' and 4'. The user rests his finger on the reproductions 3' and 4' to hence select the heating elements 5 lying under the cooking utensils. The cooking power, cooking time and those parameters usually involved in conventional cooking hobs are selected by again resting the finger on the underlying part of the screen.

According to the invention, the heating elements 5 form a matrix arrangement (see FIGS. 5, 6, 7, 8), a diode 15 being connected in series with each heating element 5. The resistance elements are selected and controlled by the static switches 16A1, 16A2, 16A3, . . . and 17A1, 17A2, 17A3 . . . 17An which are controlled by the control circuit 12 in the manner described hereinafter, such as to operate those heating elements 5 required by the cooking utensils (for example 3, 4), with the power chosen by the user.

Figure 5:
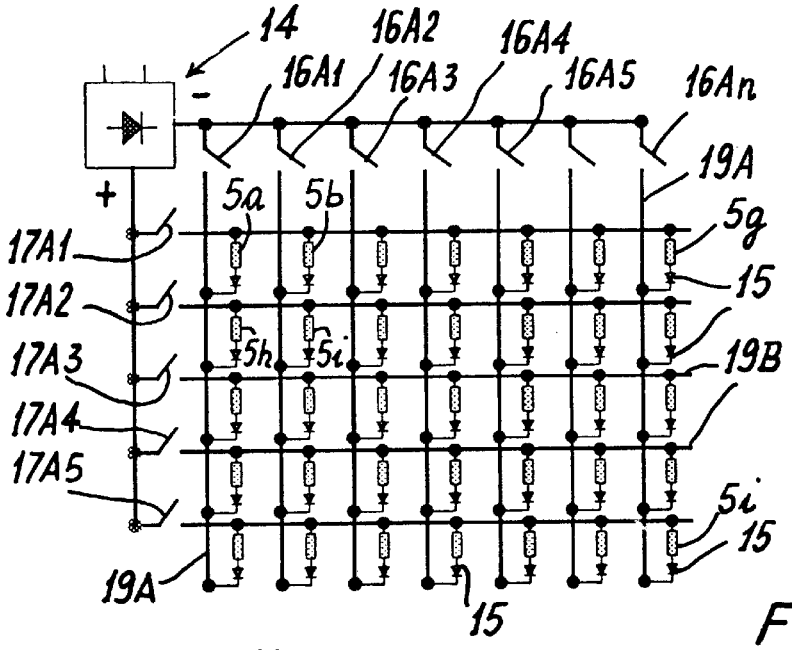
FIG. 5 is a schematic view of one embodiment of the matrix arrangement comprising static control switches and a power rectifier.

With reference to FIG. 5, it will be assumed that the cooking utensil "covers" the four heating elements 5*a, b, h* and *i*. The user touches the utensil image on the touch screen to select those heating elements and touches the touch screen to insert the desired power and start the heating process. The static switches 16A1, 16A2, 17A1 and 17A2 operate, controlled by the electronic control circuit.

Figure 6:
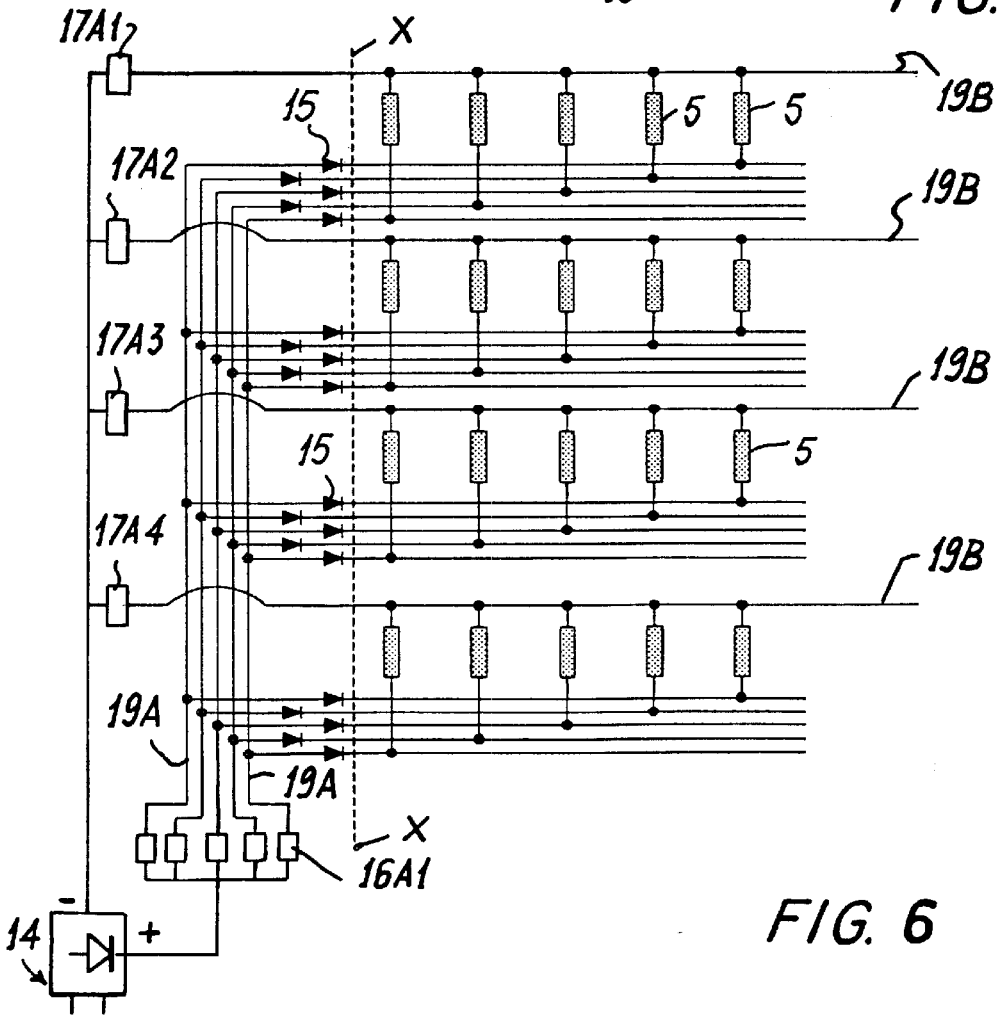
FIG. 6 is a schematic view of a different configuration of a heating element matrix arrangement with relative diodes, the arrangement itself being similar to FIG. 5.

FIG. 6 shows a resistor and diode matrix of different configuration. It corresponds functionally to that of FIG. 5 so that the same reference numerals are used in FIG. 6 for equal or corresponding parts. The matrix configuration of FIG. 6 has the advantage of allowing the diodes 15 and static switches 16A and 17A to be located to the side of the cooking hob (the left limit of which is identified in the figure by the dashed straight line x—x), hence in that "cold" region well known for example in cooking hobs with lateral controls. As can be seen, apart from the different number of heating elements 5 than in FIG. 5, the diodes 15 are disposed in the reverse direction, as are the signs of the rectifier output.

Figure 7:
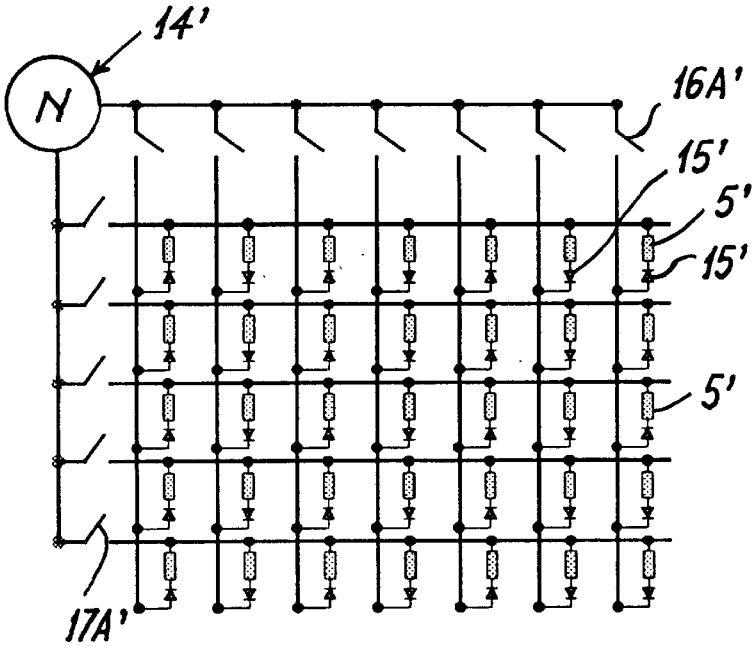
FIG. 7 shows another embodiment of the heating element matrix with static control switches, and powered by alternating current.
Figure 8:
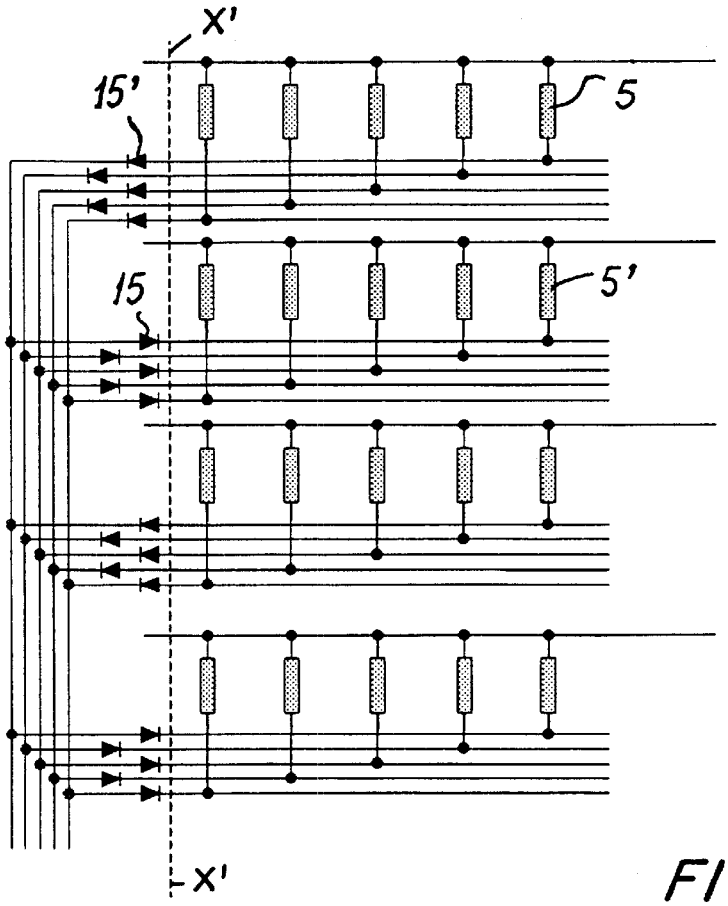
FIG. 8 is a schematic view of a different configuration of a heating element matrix arrangement with relative diodes, the arrangement itself being similar to FIG. 7.

The matrixes of FIGS. 7 and 8 correspond respectively to those of FIGS. 5 and 6. The same reference numerals with apostrophes are used to indicate equal or corresponding parts. The matrixes are however intended to be powered by an alternating current source 14', this requiring the diodes 15' to be arranged alternately from one heating element to the next.

In this case the static switches 16' and 17' can be SCRs or MOSFETs instead of TRIACs.

In FIG. 8 the static switches are not shown, to avoid unnecessary repetition.

The heating elements are controlled in the following manner.

The heating elements 5*a, b, c* etc. are dimensioned to dissipate a power much greater than the value generally used in conventional cooking hobs, which is about 7 Watt/cm$^2$ (at least twice, but preferably from 4 to 8 times, and even more preferably greater than or equal to 15 Watt/cm$^2$). This means that the heating elements 5*b, b* . . . must be connected by static switches 16, 17 to the line voltage in pulsed mode to prevent them and the overlying glass ceramic plate 2 from undergoing damage.

Control can be by the full-wave method (in which the static switches 16, 17 relative to the rows and columns of the matrix are activated when the feed voltage crosses zero).

The fact that the thermal power of the heating element (5*a, b, c* . . . ) is greater than the maximum allowable mean power enables the power to be distributed between several cooking utensils and avoid activating those regions of the cooking hob not covered by the cooking utensil, as will be clear from the following description given by way of example with reference to FIGS. 9A–9K and 10A–10K, where FIGS. 9A–9K relate to a solution for pure comparison purposes whereas FIGS. 10A–10K relate to a solution in accordance with an aspect of the invention.

We shall assume that a cooking hob on which two cooking utensils (saucepans) rest on the regions A and B is to be powered at the following values (in the case of FIGS. 9A–9K):

Instantaneous power=maximum allowable mean power;

Control period T divided into 10 half-waves of duration $T_t$ (using the European frequency $T_t$=10 ms and T=0.1 sec.).

The power level for the region A is equal to 80% of the maximum allowable mean power, and that of the region B is equal to 40% of said power.

Figure 9A:
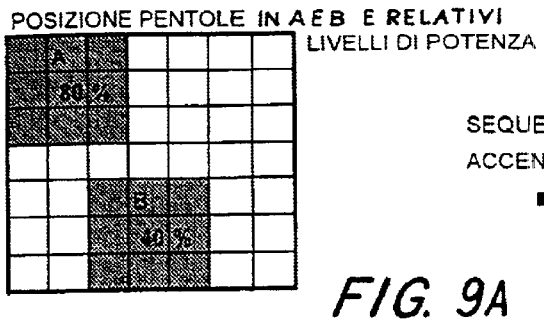
Figure 9B:
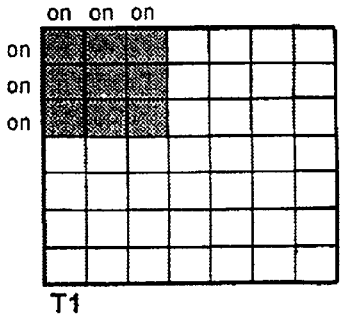
Figure 9C:
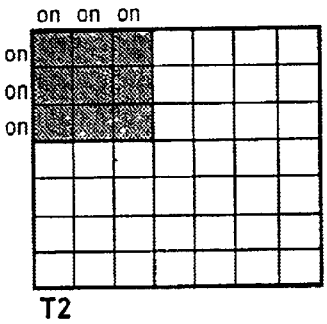
Figure 9D:
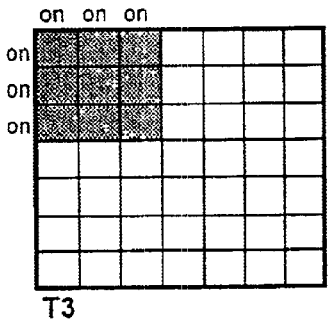
Figure 9E:
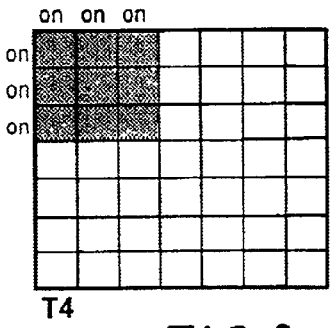
Figure 9F:
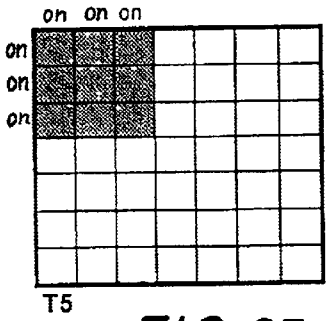
Figure 9G:
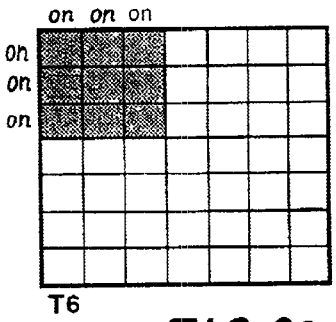
Figure 9H:
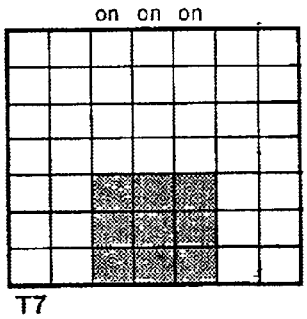
Figure 9I:
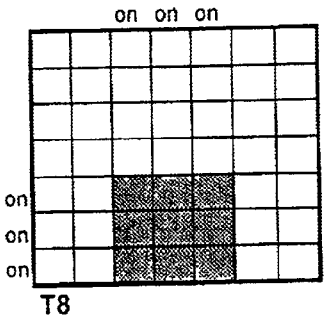
Figure 9L:
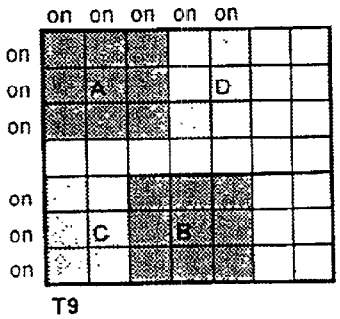
Figure 9M:
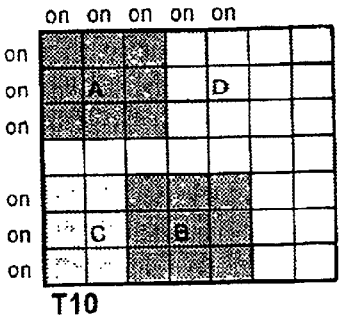

Hence 8 half-waves in 10 have therefore to be supplied to the heating elements of region A, whereas only 4 half-waves in 10 to those of region B. It is evident that there will be at least 2 gaps (for example T9 FIG. 9 and T10 FIG. 10) in which rows and columns of both regions are switched on with relative activation of heating elements not required by the cooking utensil (these regions not required are indicated by C and D in FIGS. 9L and 9M).

We shall now assume that a cooking hob is to be powered having the same elements shown in FIG. 9 but in accordance with one aspect of the invention as shown in FIGS. 10A–10K, and where:

Instantaneous power=twice maximum allowable mean power (hereinafter defined, where necessary for the purpose of descriptive clarity, as uprated power).

The figures of region A have to receive 80% of the maximum allowable mean power with only 4 half-waves of the uprated power, whereas for region B 40% of the maximum allowable mean power is required and hence each underlying heating element must be powered with only two half-waves of the uprated power.

The powering method distributes the half-waves in each time interval $T_1 \ldots T_{10}$ (FIGS. 10B–10M) within the control period T such as to: achieve the desired power level; minimize the difference between the number of resistance elements powered in each of the component time intervals $T_t$ of the control period T to reduce flicker (in the example the difference between these powered resistance elements never exceeds 1); prevent that, during each time interval ($T_1$, $T_2$, $T_3$–$T_n$), line and column combinations are activated which power resistance elements not required by the cooking utensil.

By way of example, a possible sequence is shown in which the number of active resistance elements does not exceed 6 in number, and between successive time intervals the difference in the number of resistance elements is not greater than one.

Figure 10A:
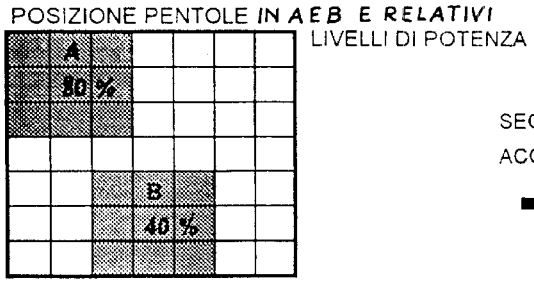
Figure 10B:
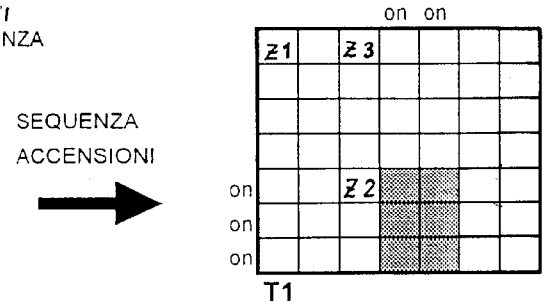
Figure 10C:
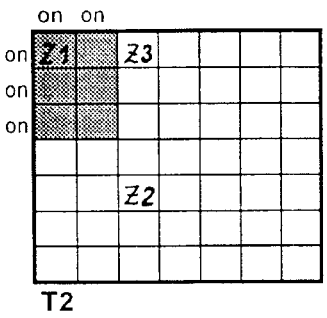
Figure 10D:
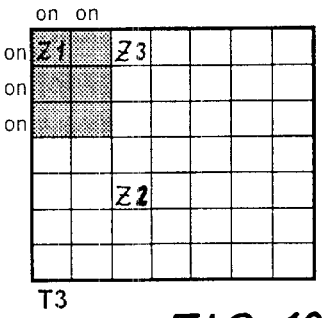
Figure 10E:
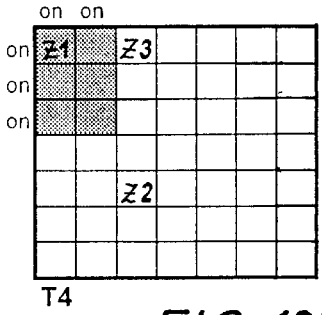
Figure 10F:
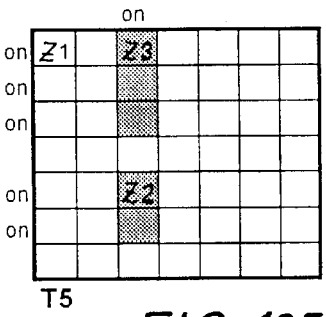
Figure 10G:
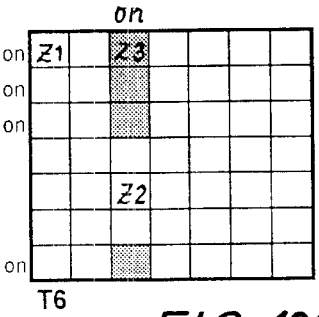
Figure 10H:
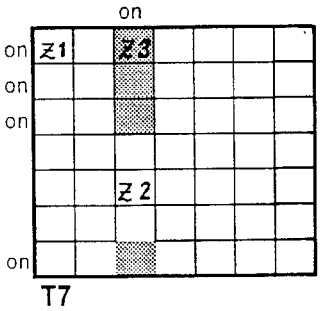
Figure 10I:
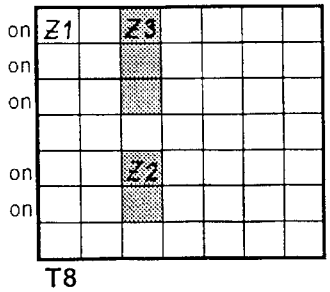
Figure 10L:
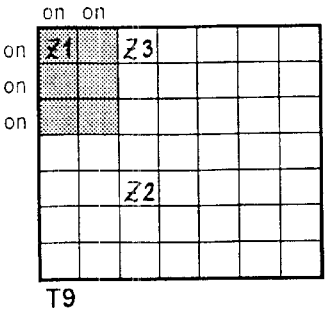
Figure 10M:
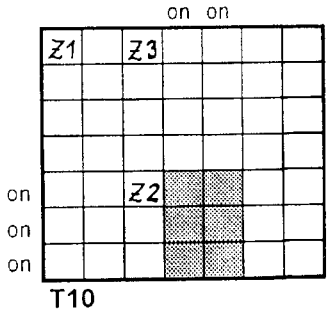

It should be noted that each of the matrixes relative to the times $T_1$ to $T_{10}$ (FIGS. from 10B to 10K) is such that resistance elements not covered by the cooking utensil are not activated. Mathematically this is expressed by the fact that each of these matrixes ($T_1$–$T_{10}$), known as time matrixes, must necessarily be of unitary rank. The time matrix represents in a given time interval the energy state (on-off) of the heating element elements. It should be noted that the rank of a matrix is the number of rows/columns which are linearly independent, i.e. which cannot be obtained by a linear combination of the other rows/columns. In this specific case, in FIG. 10K, for example, all the heating elements are positioned along the same column, indicating that the matrix is of rank 1; the matrix for example of FIGS. 10B and 10C is also of rank 1 as the heating elements are repeated identically in the adjacent column. Moreover, as can be seen, it is not necessary to activate in $T_1$–$T_{10}$ those resistance elements relative to only one of the two cooking utensils, but instead, according to the invention, resistance elements pertaining to different cooking regions can be activated simultaneously. The time matrix has been chosen as 10 elements only for simplification purposes. The time base will in fact be chosen equal to the number of energy levels for the ratio of galvanic power to the maximum allowable mean power (with 10 energy levels of regulation, the time matrix will preferably be of 40 elements).

FIG. 11 shows the voltage variation with time across three resistance elements for example; these three resistance elements are those indicated by $Z_1$, $Z_2$ and $Z_3$ in FIGS. 10B–10M.

The ten matrixes $T_1$–$T_{10}$ form overall a matrix D(i.j.t) the values of which are 0 (resistance element inactive) or 1 (resistance element active). The indexes i and j relate to the rows and columns and t to the time interval considered.

The time matrix has been chosen as 10 elements only for simplification purposes. The time base will in fact be chosen equal to the number of energy levels for the ratio of galvanic power to the maximum allowable mean power (with 10 energy levels of regulation, the time matrix will preferably be of 40 elements).

For safety reasons, i.e. to prevent dangerous situations arising in the cooking hob (such as creep of the glass ceramic plate) due for example to the static switch remaining in its conduction state, the cooking hob is provided with a total absorbed current sensor (for example a Hall sensor) at the mains supply, which on sensing a dangerous current intensity totally deactivates the cooking hob, either directly or indirectly (by comparison with the value provided by a control algorithm).

The following solutions also fall within the scope of the invention:

a) fixing the terminal pins of the resistors to the printed circuit board PCB by soldering;

b) removably connecting said pins into sockets mounted on the printed circuit board PCB.

We claim:

1. A cooking hob comprising a glass ceramic plate and an underlying plurality of electrical heating elements each having an electrical connection, the plurality of heating elements being disposed in matrix configuration and controlled by static switches in order to be able to use at will any region of said hob for heating the contents of one or more cooking utensils, wherein a diode is present in series with each electrical heating element and wherein there is present at least one printed circuit board (PCB) carrying tracks relative to the electrical connections.

2. A cooking hob as claimed in claim 1, wherein the plurality of electrical heating elements has a maximum mean power dissipation of 15 Watt/cm$^2$.

3. A cooking hob as claimed in claim 2, wherein the diodes and the static switches are located in a compartment below the heating elements and separated thermally from them, and preferably struck by a stream of cooling air.

4. A cooking hob as claimed in claim 3, wherein the static switches are controlled by an electronic control circuit which receives information relative to the position or positions assumed on the plate by one or more cooking utensils and to the power levels set by the user for each cooking utensil, in order to operate by means of the static switches those heating elements corresponding to said position or positions, to supply to each cooking utensil a power adjustable independently of the power, also adjustable, of the other cooking utensil or utensils present.

5. A cooking hob as claimed in claim 1, wherein the printed circuit board (PCB) presents contacting spring clips, the electrical heating elements being associated with contact pins to be removably engaged by said clips.

6. A cooking hob as claimed in claim 5, wherein the diodes are supported by said printed circuit board (PCB).

7. A cooking hob as claimed in claim 1, wherein the resistance elements are soldered by their terminals to the printed circuit board or boards (PCB).

8. A cooking hob as claimed in claim 1, further comprising a current sensor measuring the current fed to said hob and intervening directly or indirectly to produce total deactivation of the cooking hob on measuring a current exceeding the value provided by the control algorithm.

9. A cooking hob as claimed in claim 1, wherein the number of static switches is less than the number of heating elements.

10. A cooking hob comprising a glass ceramic plate and an underlying plurality of electrical heating elements each having an electrical connection, the plurality of heating elements being disposed in matrix configuration and controlled by static switches, in order to be able to use at will any region of said hob for heating the contents of one or more cooking utensils, wherein a diode is present in series with each electrical heating element and an electronic control circuit is present for controlling the static switches, which receives process data from a touch screen connected to a video camera scanning the cooking hob.

11. A cooking hob as claimed in claim 10, wherein there is present at least one printed circuit board (PCB) carrying tracks relative to each of the electrical connections.

12. A cooking hob as claimed in claim 10, further comprising a current sensor measuring the current fed to said hob and intervening directly or indirectly to produce total deactivation of the cooking hob on measuring a current exceeding the value provided by the control algorithm.

13. A cooking hob as claimed in claim 10, wherein the number of static switches is less than the number of heating elements.

14. A cooking hob as claimed in claim 10, wherein the plurality of electrical heating elements has a maximum mean power dissipation of 15 Watt/cm$^2$.

15. A control method for a cooking hob comprising a glass ceramic plate and an underlying plurality of electrical heating elements each having an electrical connection, the plurality of heating elements being disposed in matrix configuration and controlled by static switches present in a number less than the number of heating elements, in order to be able to use at will any region of said cooking hob for heating the contents of one or more cooking utensils, said matrix comprising a diode in series with each resistance element and at least one printed circuit board (PCB) carrying tracks relative to each of the electrical connections, wherein the electrical heating elements are fed with line voltage in pulsed mode with a power substantially greater than a maximum allowable mean power, the matrix which represents in each pulsation the energy state of the heating elements (on-off) having unitary rank.

16. A method as claimed in claim 15, wherein the feed power is equal to or greater than twice the maximum allowable mean power.

* * * * *